US006368002B1

(12) United States Patent
Saund et al.

(10) Patent No.: US 6,368,002 B1
(45) Date of Patent: Apr. 9, 2002

(54) PARKING MECHANISM FOR STORING AND EXCHANGING END EFFECTORS USED IN A SYSTEM FOR PERFORMING ACTIONS OVER VERTICAL SURFACES

(75) Inventors: Eric Saund, San Carlos; Mark H. Yim, Palo Alto, both of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/450,466

(22) Filed: Nov. 29, 1999

(51) Int. Cl.[7] ..... B43K 23/02
(52) U.S. Cl. ..... 401/131; 33/1 M; 346/139 R
(58) Field of Search ..... 347/2, 29, 32; 346/139 R, 140.1; 401/131, 196, 203; 33/1 M

(56) References Cited

U.S. PATENT DOCUMENTS 4,135,245 A * 1/1979 Kemplin et al. ..... 346/139 R
4,288,798 A * 9/1981 Hollmayer ..... 346/139 R
4,401,996 A * 8/1983 Shirahata ..... 346/139 R
4,496,958 A * 1/1985 Brandt et al. ..... 346/139 R
4,501,931 A * 2/1985 Ohya et al. ..... 345/175
4,564,078 A * 1/1986 Enokido et al. ..... 178/19.01
4,583,292 A * 4/1986 Langberg ..... 33/1 M
4,628,326 A * 12/1986 Fukumura et al. ..... 346/139 R
4,833,490 A * 5/1989 Zur ..... 346/139 R
5,232,103 A * 8/1993 Koenig et al. ..... 211/69.5

FOREIGN PATENT DOCUMENTS

JP 07107220 A * 4/1995 ..... H04N/1/00

* cited by examiner

*Primary Examiner*—John Barlow
*Assistant Examiner*—Julian D. Huffman

(57) ABSTRACT

The Pendulum Whiteboard Printer is a fully-automatic robotic device for marking or otherwise effecting whiteboards, pinboards, or other vertical surfaces. The physical device consists of an effector platform suspended by two suspension wires whose lengths are adjusted by motorized spindles mounted above and on either side of the board surface. The position of the effector platform is adjusted by winding and unwinding the wires. Electrical power is supplied to the effector platform through the suspension wires or through an on-board battery. Control of a pen and/or other apparatus on the effector platform is achieved through modulation of the power voltage. A parking facility is provided as a resting place for the effector platform for such purposes as keeping pens from drying out.

2 Claims, 5 Drawing Sheets

PARKING MECHANISM FOR STORING AND EXCHANGING END EFFECTORS USED IN A SYSTEM FOR PERFORMING ACTIONS OVER VERTICAL SURFACES

FIELD OF THE INVENTION

The present invention relates generally to performing mechanical actions such as printing, and more particularly to a parking facility for a platform for carrying end effectors for performing the mechanical actions on whiteboards and other substantially vertical surfaces.

BACKGROUND OF THE INVENTION

A great deal of work has been devoted to integrating large drawing and display surfaces with electronic document faculties. Technology has been developed to support two directions of information flow, image capture, and image display.

Image capture technologies enable marks drawn on a surface to be captured in electronic form. These include the pressure-sensitive tablets such as the SMART Board from SMART Technologies, Inc. of Calgary, Alberta, Canada, location-sensitive surfaces accompanied by special pens such as the Liveboard from Xerox Corporation of Stamford, Conn., and Mimeo from Virtual Ink Corporation of Boston, Mass., Laser-based pen trackers such as the SoftBoard from Microfield Graphics, Inc. of Portland, Oreg., camera-based scanning such as the ZombieBoard from Xerox Corporation, and 1-dimensional scan bars such as the Copyboard from Xerox Corporation. The ZombieBoard is further described in U.S. Pat. No. 5,528,290 to Saund, entitled DEVICE FOR TRANSCRIBING IMAGES ON A BOARD USING A CAMERA BASED BOARD SCANNER.

Image display technologies permit stored electronic images to be displayed on a large surface. These include plasma, active matrix, liquid crystal, light-emitting diode, and projectors which can be either front-projection or rear-projection. Of the various image display technologies, only the projectors are compatible with an inexpensive, passive, surface of variable and extensible size. All of the others require dedicated display hardware which is expensive and fixed in size.

In addition to the applications for generating images on large vertical surfaces, a variety of other applications exist such as window washing, moving physical tokens, and the like.

SUMMARY OF THE INVENTION

The present invention is a parking facility for a platform, called an effector platform, for carrying and/or manipulating end effectors to perform various mechanical tasks. The effector platform of the present invention is part of a Pendulum Whiteboard System which is so named because the effector platform of the present invention is suspended against the force of gravity by suspension wires. It is not a true pendulum in the x-y plane because two wires are used.

The present invention provides an inexpensive mechanism for remotely generating images on whiteboards and other substantially vertical surfaces. The term "image" as used in this specification refers to any marking created by a marking element such as a dry-erase pen. The markings may be in the form of textual characters, straight or curved strokes, or the like.

The effector platform is provided for holding the marking element. The effector platform is suspended by two wires from two spools placed near the upper boundaries of the surface to be marked on. The lengths of these wires control the location of the effector platform over the surface to be marked on. These wires are typically wound on motorized spools permitting their lengths to be varied under computer control. The spools may be located above and beyond the ends of the target surface so that all parts of the surface are reachable.

The present invention provides an inexpensive mechanism for remotely generating images on whiteboards and other substantially vertical surfaces. The term "image" as used in this specification refers to any marking created by a marking element such as a dry-erase pen. The markings may be in the form of textual characters, straight or curved strokes, or any other types of marks that could be hand-drawn.

The effector platform is provided for holding an end effector such as the marking element. The effector platform is suspended by two wires from two spools placed near the upper, outer, boundaries of the surface to be marked on. The lengths of the two wires are adjusted to control the location of the effector platform over the surface to be marked on. These wires are typically wound on motorized spools permitting their lengths to be varied under computer control. The spools may be located above and beyond the ends of the target surface so that all parts of the surface are reachable. If needed, control signals to the effector platform can be provided through the wires using techniques well-known in the art. Power may be supplied to the effector platform through the wires or using an on-board battery.

A parking facility is provided for the effector platform. It is useful for such situations as where marking pens may dry out and need to be returned to a location where the tips may be sealed from the surrounding air, in situations where interchangeable end effectors are used, or for providing a known location for calibration.

DETAILED DESCRIPTION OF THE INVENTION

Figure 1:
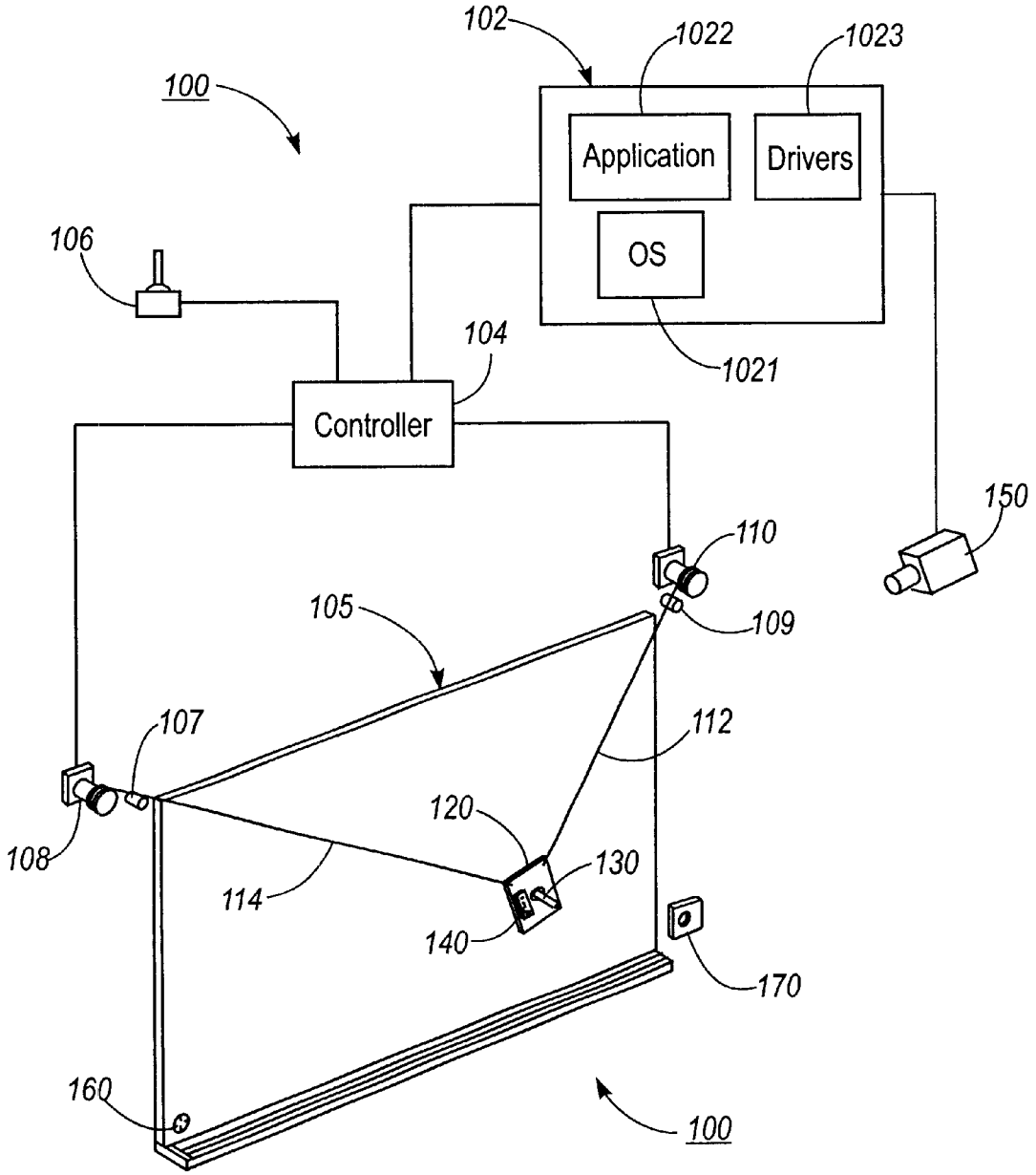
FIG. 1 is a block/perspective view diagram of a Pendulum Whiteboard Printer system according to the present invention.

FIG. 1 depicts the Pendulum Whiteboard Printer system of which the present invention is a part. An end effector 130 such as marking pen or the like is used for creating images on a whiteboard 105. Those skilled in the art will readily appreciate that a dry-erase marker will typically be used for whiteboards. Those skilled in the art will further appreciate that the present invention is not limited to marking on whiteboards, but may be used with any substantially-vertical surface, and that the action performed by the whiteboard printer is not limited to simply making marks, but may also be used for performing other actions, as is discussed in greater detail in concurrently filed, co-assigned, U.S. patent application Ser. No. 09/450,467 entitled METHOD FOR EFFECTING ACTIONS OVER VERTICAL SURFACES, which is hereby incorporated by reference into the present specification. For ease of discussion, the vertical surface will be referred to herein as a whiteboard. The end effector, 130 is held in place and moved with the effector platform 120 of the present invention. The effector platform 120 is suspended from a left wire 114 and a right wire 112. The left wire 114 is connected to a left spool 108, and the right wire 112 is connected to a right spool 110. The left and right spools are equipped with motors (not shown) of types well-known in the art which control the reeling in and unreeling of wire from the spool. The motors may be stepper motors, or DC motors with shaft sensors or position sensors, or any other such mechanism capable of turning the spools in a controlled manner to reel in and unreel wire. Those skilled in the art will recognize that for such reasons as better control, faster acceleration, more accurate fast positioning, greater tension to control jiggle and bounce, greater tension to produce z-force, control while moving, among others, more than two wires may be used without departing from the spirit and scope of the present invention.

When the whiteboard printer 100 is not in use, the effector platform 120 can be returned to the parking facility 170 of the present invention to keep pens from drying out, among other reasons. The effector platform 120 is discussed in greater detail in concurrently filed, co-assigned, U.S. patent application Ser. No. 09,450,484 entitled EFFECTOR PLATFORM FOR PERFORMING ACTIONS OVER VERTICAL SURFACES, which is hereby incorporated by reference into the present specification. The parking facility 170 may also be mounted on wall 199.

The whiteboard printer 100 will typically be controlled by a computer 102, through a controller 104, which may be implemented in hardware or software, and may be a separate unit or part of the computer 102. The computer 102 operates under the control of Operating System (OS) 1021 and may be any general-purpose computer known in the art. The computer 102 communicates with the whiteboard printer 100 through the controller 104 by way of an interface 103, which may be any commonly-used computer communication interface such as a parallel or a serial interface. If closed-loop positioning is utilized, a camera 150 may be used to provide feedback information to the computer 102, as depicted, or directly to the controller 104. The calculations described below for positioning the effector platform 120 may be performed by the computer 102 and/or the controller 104 and may be implemented in software and/or hardware. Driver programs 1023 for application programs 1022 for such applications as word processing, spreadsheets, and presentation graphics, among others, may be provided to generate their respective outputs on large vertical surfaces. If desired, the positioning of the effector platform 120 may also be manually controlled using a joystick 106 connected to the controller 104, as shown, or to the computer 102. Signals from the computer 102 or joystick 106 are translated by the controller 104 and transmitted to the effector platform 120, where they are decoded by the onboard control electronics 140.

Since the effector platform 120 is suspended from the two wires 114 and 112, the effector platform 120 may be moved to any position beneath and between the left spool 108 and right spool 110 by adjusting the lengths of the left and right wires 114 and 112, respectively. In order to be able to mark on any part of the whiteboard 105, the left and right spools 108 and 110, respectively, are preferably placed above the top edge of the whiteboard and beyond the left and right edges of the whiteboard, respectively, as shown in FIG. 1.

The positioning of the effector platform 120 is described in greater detail, along with other aspects of the Pendulum Whiteboard Printer of which the effector platform is a part, in concurrently filed, co-assigned, U.S. patent application Ser. No. 09/450,468 entitled SYSTEM FOR EFFECTING ACTIONS OVER VERTICAL SURFACES, which is hereby incorporated by reference into the present specification.

Figure 3:
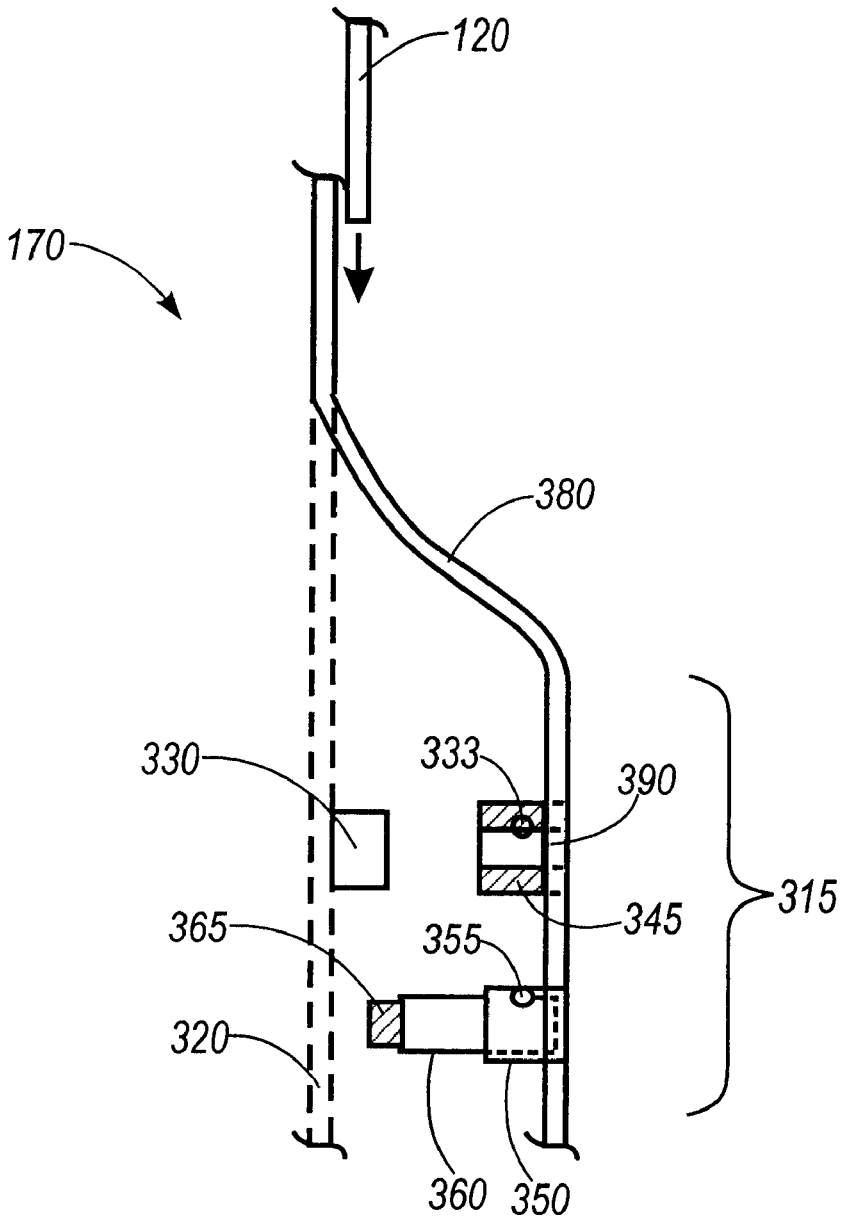
FIG. 3 is a side plan view diagram of a parking structure according to the present invention.
Figure 5:
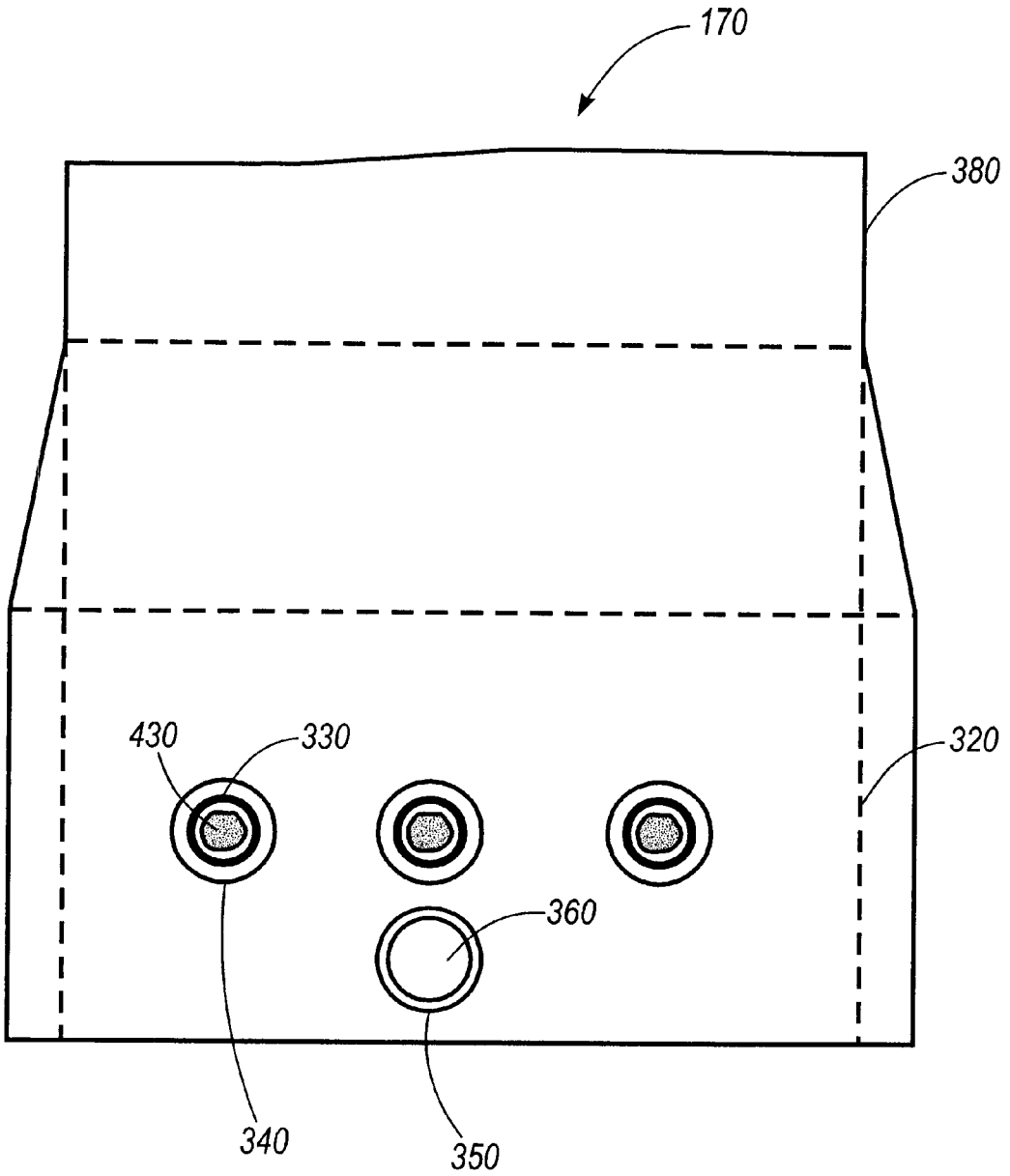
FIG. 5 is an elevation view diagram of a parking structure according to the present invention.

Referring to FIGS. 3 and 5, an exemplary parking facility 170 according to the present invention is shown. The parking facility includes a base 320, a guide wall 380, and a cap sealer 330.

According to a present embodiment of the invention, a marking pen 310, such as a dry-erase marker, is used as the primary end effector for creating marks. The pen 310 is held in a sleeve 340. An actuator (not shown) acts to slide the pen 310 toward and away from the whiteboard surface 105.

Figure 2:
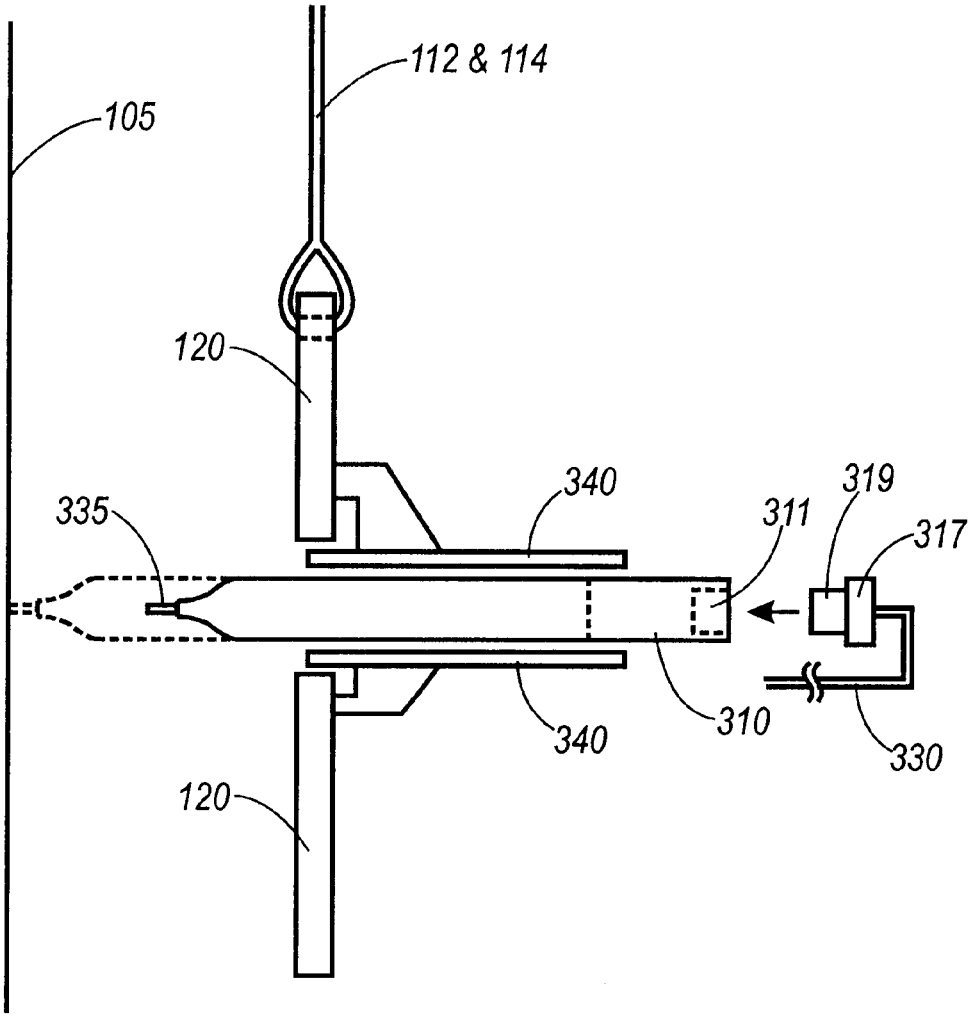
FIG. 2 is a side plan view of an effector platform according to the present invention.

FIG. 2 depicts the pen 310 in a position partially retracted away from the surface 105 to enable the effector platform 120 to be moved to a desired location. The pen 310 is then protracted, as depicted by the dashed outline, to touch the surface 105 at the desired target location(s) in order to create marks. When the effector platform 120 is moved to/from the parking facility, it is desirable to retract the marking pen completely into the sleeve 340 so that the marking tip 335 does not protrude beyond the surface of the effector platform 120 facing the whiteboard 105.

Referring to FIGS. 3 and 5, an exemplary parking facility 170 according to the present invention is shown. The parking facility includes a base 320, a guide wall 310, and a cap sealer 330.

The base 320 is used to mount the parking facility 170 to a wall or other substantially vertical surface. As shown in FIG. 1, the parking facility is mounted near the whiteboard surface 105 in a horizontal position between the left and right spools 108 and 110. The vertical position of the parking facility should be below the vertical level of the left and right spools, but should be high enough that the effector platform 120 may be lowered down to the parking facility 170.

The cap sealer 330 is mounted on the outer surface of the base 320, i.e., the surface facing toward the guide wall 380 and away from the wall to which the parking facility is mounted.

Figure 4:
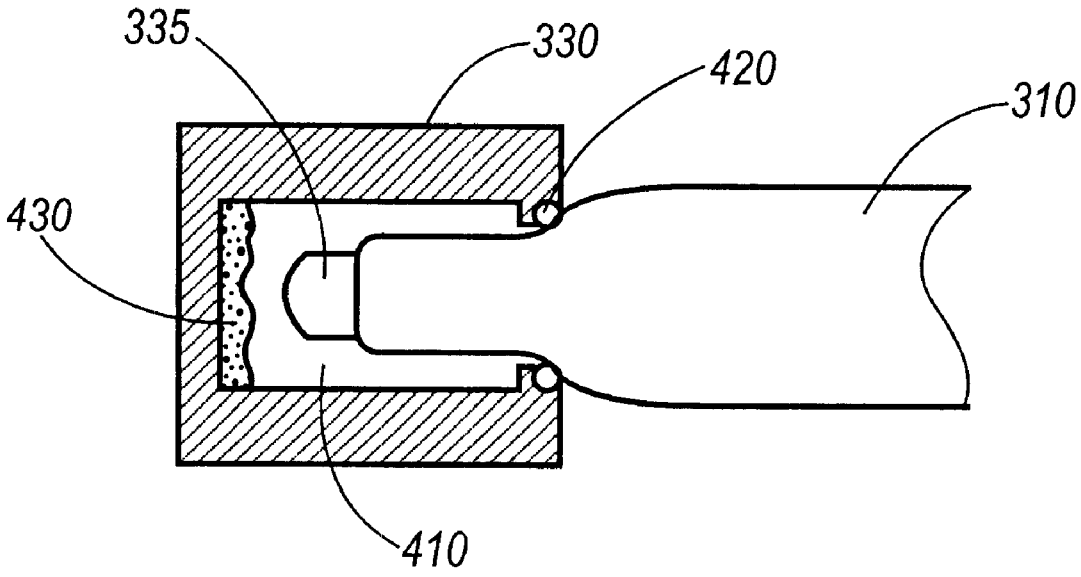
FIG. 4 is a side plan view of a cap sealing mechanism for the parking structure according to the present invention.

Referring to FIG. 4, the cap sealer 330 is configured as a hollow cup-shaped structure to receive the tip of the marking pen 310 and seal the marking tip 335 from the surrounding air to keep the marking tip 335 from drying out. To increase the moisture retaining properties of the cap sealer 330, an o-ring 420 is fitted to the opening of the cap sealer 330, and a moisture preservative 430 is applied to the inside of the cap sealer. The moisture preservative 430 may be a sponge, or other absorptive material which is moistened as needed, either manually, using an effector platform that is equipped with a nozzle or sprayer for dispensing water or other such liquid, or through a liquid dispenser (not shown) such as a bottle connected directly to the parking platform.

Returning to FIGS. 3 and 5, the guide wall 380 is mounted to, the front surface of the base 320, and is configured to slant or curve out from the base and then angle back to form a resting area 315 that is substantially parallel to the base 320. A hole 390 is provided in the resting area 315 directly in front of the cap sealer 330. The hole 390 is configured to be sufficiently large for the marking pen 310 to easily slide through, and is positioned so that the tip of the marking pen is directly aligned with the cap sealer 330. The hole may also be fitted with a pen support 345, which may be implemented as a semi-circular portion of a hollow tube, as shown, or as a complete sleeve. The parking facility 170 is designed so that when the effector platform 120 slides down the guide wall 380, the effector platform is displaced away from the vertical plane in which it normally hangs. When the effector platform 120 reaches the resting area 315, the effector platform returns to the vertical plane and rests against the surface of the guide wall 380 at the resting area 315. Those skilled in the art will recognize that for those applications where the parking facility is recessed into the mounting wall itself such that the resting area is substantially flush with the mounting wall, the guide wall need not slant or curve out from the base.

For embodiments of the effector platform 120 implementing interchangeable end effectors, the parking facility may be configured to store the various end effectors. For example, where marking pens 310 are used, an eraser 360 end effector may be provided. A storage sleeve 350 is provided in the guide wall 380 for holding the eraser 360. As with the pen support 345, the storage sleeve may be implemented as a complete sleeve, as shown, or may be any semi-circular portion thereof.

To change between the marking pen 310 and the eraser 360, the effector platform 120 would first be positioned over the guide wall such that the marking pen 310 is aligned with the hole 390. Then, the marking pen 310 is protracted from the pen support 345 of the effector platform 120, through the hole 390, until the marking pen 310 engages the cap sealer 330, and the marking tip is sealed in a chamber formed by the o-ring 420 contacting the tip of the marking pen, as shown in FIG. 4. The protracting of the marking pen 310 into the hole 390_may be performed entirely by the effector platform 120, or may be assisted by a motorized pen roller 333 provided in a pen support implemented as a complete sleeve.

The marking pen 310 is then released from the effector platform 120. The distance between the guide wall 380 and the base 320 of the parking facility 170 is such that the marking pen 310 does not extend beyond the front surface of the guide wall 380 when the pen stored in the parking facility 170.

After the marking pen 310 has been stored, the effector platform 120 is moved into position such that the pen support 345 of the effector platform 120—is aligned with the storage sleeve 350 holding the eraser 360. The effector platform 120 draws the eraser 360 from the storage sleeve 350, either by itself, or by a motorized eraser roller 355 or other pen grabber, into the pen support 345 of the effector platform 120.

As can be seen in FIG. 5, effector platforms with multiple marking pens mounted therein can be accommodated by the parking facility 170 by providing a corresponding number of holes 390 and cap sealers 330.

Those skilled in the art will readily appreciate that described herein are merely an exemplary configuration for the parking facility, and will recognize that other configurations are possible for marking pens and for end effectors other than marking pens. A wide range of end effectors can be implemented on the effector platform, examples of which are described in greater detail in concurrently filed, co-assigned, U.S. patent application Ser. No. 09/450,484 entitled EFFECTOR PLATFORM FOR PERFORMING ACTIONS OVER VERTICAL SURFACES, which was incorporated by reference into the present specification.

With any of the possible end effector implementations, the parking facility 170 may be used in various ways beyond merely serving as a stopping place. For instance, the parking facility may be provided with various passive and active components for storing materials and components such as end effectors, components for facilitating effector platform-parking facility interaction, such as the motorized pen roller 333_shown in FIG. 3, or sensors for determining the proximity of the effector or end effector to the parking facility or for determining whether certain materials such as ink or cleaner need to be replenished. The parking facility may also be used to swap between various end effectors, or resupply ink, paint, whiteout, cleaning fluid, or other such liquid or semi-liquid material being applied to a substantially vertical surface. Further, the parking facility could be implemented with a vacuum or other cleaning device for removing material from an eraser, squeegee, or other end effector provided with a cleaning element. Additionally, if power is supplied by a battery, the parking platform could serve as a recharging station. Those skilled in the art will recognize that these implementations can be readily practiced using techniques well-known in the art.

What is claimed is:

1. A parking facility for an effector platform adapted to carry an end effector that performs an action at selected locations on a substantially vertical display surface, the effector platform being connectable to first and second effector platform positioners which cooperate to position the effector platform to the selected location, the parking facility comprising:

a base for mounting said parking facility to a substantially vertical surface;

a guide wall coupled to said base, said guide wall for interfacing said effector platform with said parking facility, said guide wall having a resting area, the resting area being substantially vertical; and one or more receptacles in said resting area, said one or more receptacles for receiving one or more end effectors.

2. The parking facility of claim 1, wherein an end effector is a pen having a marking tip, the parking facility further comprising a capping structure configured to receive the marking tip of the pen, the capping structure being provided on the base.

* * * * *